US006793556B1

(12) United States Patent
Fildan et al.

(10) Patent No.: US 6,793,556 B1
(45) Date of Patent: Sep. 21, 2004

(54) BRASSIERE WITH INVISIBLE FRONT CLOSURE

(75) Inventors: Gerhard Fildan, Vienna (AT); Karl Wanzenböck, Leobersdorf (AT)

(73) Assignee: Fildan Accessories Corporation, Humble, TX (US)

( * ) Notice: Subject to any disclaimer, the term of this patent is extended or adjusted under 35 U.S.C. 154(b) by 0 days.

(21) Appl. No.: 10/622,442

(22) Filed: Jul. 18, 2003

(51) Int. Cl.[7] ..... A41C 3/00; A41F 1/00

(52) U.S. Cl. ..... 450/58; 450/1; 24/695; 24/694; 2/323; 2/336

(58) Field of Search ..... 450/1, 58, 36, 450/33, 82, 28, 9, 15, 17, 26, 86; 2/336, 323–335, 338; 24/370, 350, 326, 318, 662, 663, 116 A, 324, 694, 695; D11/230, 231, 218; D2/705–710, 171, 853

(56) References Cited

U.S. PATENT DOCUMENTS 1,851,730 A * 3/1932 Rutherford ..... 24/700
2,765,471 A * 10/1956 Cousins ..... 450/46
2,912,984 A * 11/1959 Jensen ..... 450/46
3,445,901 A * 5/1969 Kamper ..... 24/618
D274,862 S * 7/1984 Fildan ..... D11/208
5,380,238 A * 1/1995 Crew-Gee ..... 450/36
D410,411 S * 6/1999 Fildan ..... D11/210
6,009,604 A * 1/2000 Fildan ..... 24/662
6,149,496 A * 11/2000 Fildan ..... 450/58
6,233,793 B1 * 5/2001 Wanzenbock ..... 24/615
6,499,201 B2 * 12/2002 Fildan et al. ..... 24/586.11

* cited by examiner

*Primary Examiner*—Gloria M. Hale
(74) *Attorney, Agent, or Firm*—Herbert Dubno

(57) ABSTRACT

A front closure for a brassiere which is invisible in the connected state of the front flaps of the brassiere has two closure halves each with a semielliptical plate and one with an annular formation and the other with a lug snap fitted into the annular formation. Outwardly of the annular formation and the lug, the plates form sewing flanges which can be stitched through to attach fastener halves to the brassiere halves, e.g. with a zigzag stitching.

11 Claims, 3 Drawing Sheets

BRASSIERE WITH INVISIBLE FRONT CLOSURE

FIELD OF THE INVENTION

Our present invention relates to a brassiere with a front closure which is invisible from the front and, more particularly, to a front closure for a brassiere which can be mounted in such manner that it is not visible from the front of the brassiere.

BACKGROUND OF THE INVENTION

Front-closing brassieres are particularly convenient since complications involved in reaching behind the wearer can be eliminated. The most common front closure for a brassiere utilizes a hook structure in which a hook provided with a loop through which fabric on one side of the brassiere is secured to the hook. The hook engages in loops on the other edge of the brassiere to close the latter. While such a fastener is convenient to use, it is not always sufficiently secure and invariably is visible, thereby interfering with the appearance of the garment.

Other front closures are relatively large, complex and difficult to manipulate and in order to present them from being unsightly, may be decorative features. The clean lines of a brassiere may thus be lost. It is, therefore, desirable to provide an easily mounted, convenient and substantially invisible closure for the front of a brassiere.

OBJECTS OF THE INVENTION

It is, therefore, the principal object of the present invention to provide an improved brassiere front closure which can be readily attached to the two edges of the front of a brassiere to be joined such that, when the closure halves are engaged, they are practically invisible from the front of the brassiere. It is also an object of the invention to provide a front closure for the purposes described which is convenient to use, of light weight and free from the bulkiness associated with some earlier brassiere front closures.

Still another object of the invention is to provide an improved brassiere of the front-closure type in which the front closure itself does not interfere with the aesthetics of the brassiere from the point of view of the lines of the brassiere for the fabric from which it is made.

SUMMARY OF THE INVENTION

These objects and others which will become apparent hereinafter are attained, in accordance with the invention in a front closure for a brassiere comprising:

a female closure half having a first semielliptical plate with a planar obverse surface delimited by a straight edge and a curved edge, an annular formation on a reverse side of the semielliptical plate overhanging the straight edge, and an elongated opening formed in the annular formation along the straight edge whereby a ledge is formed by the plate in the annular formation; and a male closure half having a second semielliptical plate with a planar obverse surface delimited by a straight edge and a curved edge, and a lug on a reverse side of the second semielliptical plate projecting over the edge engageable in the opening with the closure halves positioned transverse to one another, and engaging with a snap fit in the annular formation while underlying the ledge upon rotation of the closure halves into a planar position in which the planar surfaces are coplanar, the straight edges lying in contact with one another in the planar position, the semielliptical plates being attachable to juxtaposed edges of a brassiere.

According to the invention the first plate outwardly of the annular formation and the second plate outwardly of the lug are thin sewing flanges pierceable by a sewing needle stitching the closure halves to the respective edges of the brassiere.

The annular formation is generally elliptical and surrounds a generally rectangular recess with rounded corners.

The two semielliptical plates are preferably formed in one piece with the lug and the annular formation, e.g. by injection molding, for example, from nylon 6. The two closure halves are stitched on the back of the two front fabric flaps which are to adjoin at the juxtaposed edges by stitching through those flaps and the two plates along the curved edges of the latter. Since the closure halves can bring the edges of these flaps into abutment at the front of the brassiere, the closure is invisible from the front when the two parts are attached together.

The stitching can be zigzag stitching or a step stitch and, if desired, a tape can be stitched over the sewing flanges.

The invention, therefore, also is a brassiere which has, at the front thereof, a pair of fabric flaps adapted to adjoin at respective edges and secured to the male and female closure halves previously described along the backs of those flaps. When the two closure halves are brought together so that the straight edges of the respective plates lie in contact with one another in the planar position, the juxtaposed edges of the brassiere flaps are likewise brought together so as to prevent the closure from being visible from the front.

BRIEF DESCRIPTION OF THE DRAWING

The above and other objects, features, and advantages will become more readily apparent from the following description, reference being made to the accompanying drawing in which.

SPECIFIC DESCRIPTION

Figure 9:
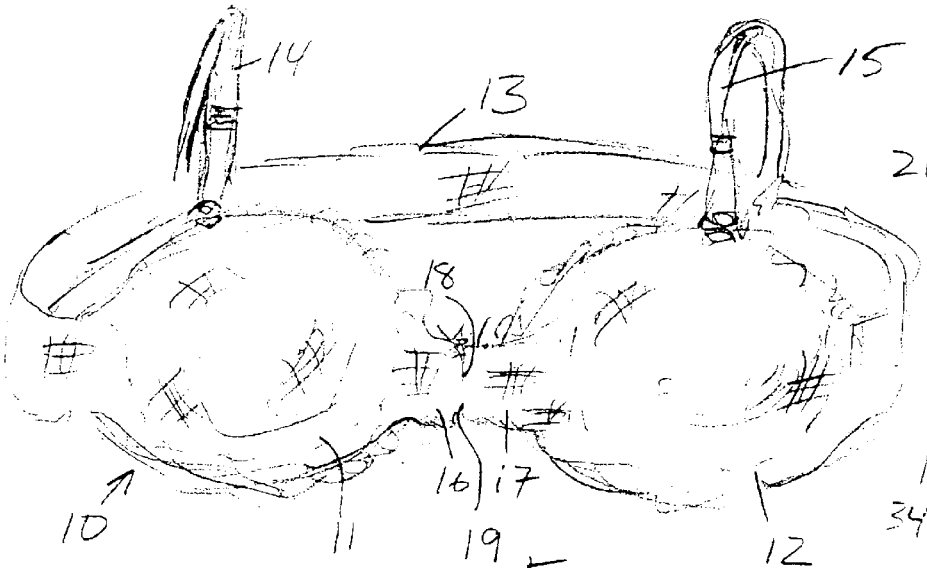
FIG. 9 is a front view of the brassiere showing the fastener secured.

In FIG. 9 we have shown a brassiere 10 which comprises two cups 11, 12 which can be of the underwire type and can be connected by a back strap 13. Shoulder straps 14 and 15 reach from the back strap 13 to the upper portions of the cups and the two cups 11 and 12 have fabric flaps 16 and 17 which are to adjoin along edges 18 and 19. The two flaps can be releasably connected together by a front closure best seen in FIGS. 1–6.

From FIGS. 1–6 it can be seen that the closure 20 comprises two closure halves 21 and 22. The first closure half 21 comprises a plate 23 of the semielliptical configuration with a rounded edge 24 corresponding to a segment of an ellipse adjoining a straight edge 25 through two rounded end sections 26 and 27. On the rear side 28 of the plate, an elliptical annular formation 29 is provided which has a rectangular recess 30 with rounded corners. The recess 30 forms a slot-like opening 31 delimited by a ledge 32.

Figure 6:
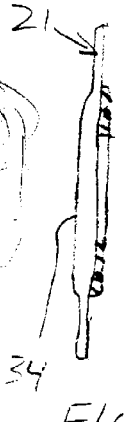
FIG. 6 is a sectional view taken along the line VI—VI of FIG. 2.

The front side 33 (FIG. 2) is generally flat but can have a raised portion 34 at the center of the plate 23 (see FIG. 6).

Figure 4:
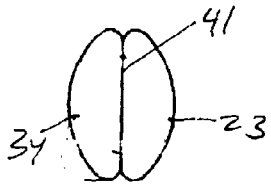
FIG. 4 is a front view of the closure in its closed position.
Figure 5:
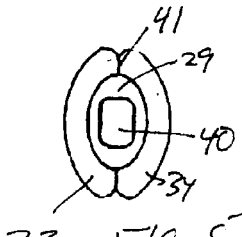
FIG. 5 is a rear view of the closure in its closed position.

The closure halves 22 has a similar semielliptical plate 34 with a rounded edge 35 in the form of an ellipse segment adjoining the straight edge 36 through rounded ends 37 and 38. On the reverse side 39 the plate 34 is formed with a lug 40 having the shape of the recess 30 and a projecting portion 41 adapted to fit into the opening 31 from the front side, when the two halves are turned so that one is generally transverse to the other. When the two halves are then rotated to snap the lug 40 into the recess 30 as shown in FIGS. 4 and 5, the two plates 23 and 34 are generally coplanar with the front surfaces flush with one another and the edges 25 and 36 adjoining one another along a line 41.

Figure 1:
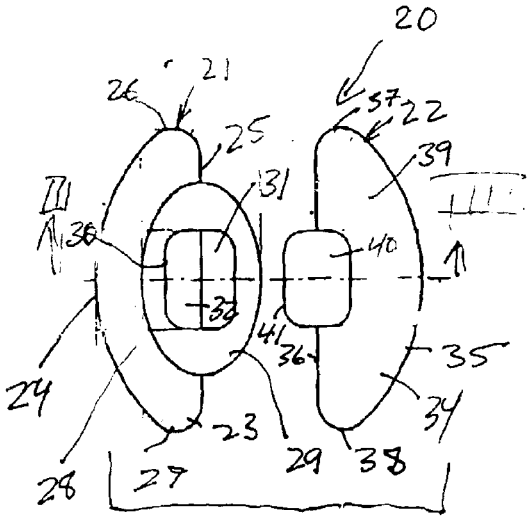
FIG. 1 is an elevational view of the brassiere front closure of the invention as seen from its back side and with the two halves of the closure separated.
Figure 2:
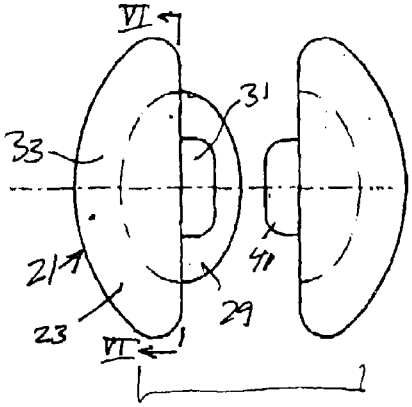
FIG. 2 is a view similar to FIG. 1 as seen from the front side of the closure.
Figure 3:
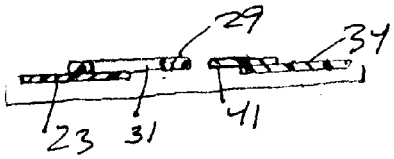
FIG. 3 is a cross sectional view taken along the line III—III of FIG. 1.

As can be seen from FIGS. 3 and 6, the portion of the plates 23 and 34 extending outwardly of the annular formation 29 and the lug 40 are thin and can be pierced by a stitching needle so that the respective halves of the fastener can be sewn to the flaps 16 and 17.

Figure 7:
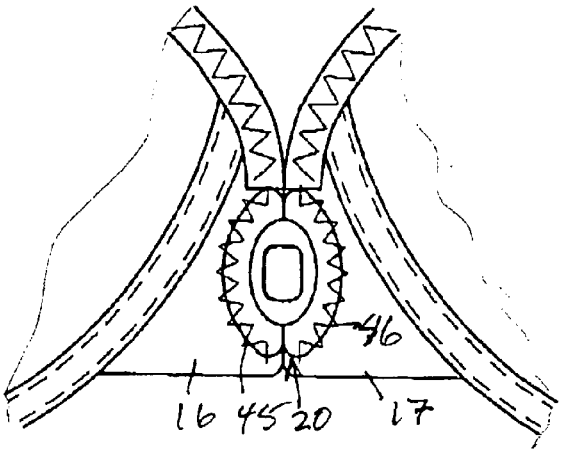
FIG. 7 is a rear view of the brassiere in the region of the fastener and in diagrammatic form.

More particularly, in FIG. 7 we have shown a fastener 20 secured to the two flaps 16, 17 by zigzag stitching 45 and 46 through each of the sewing flanges formed by the plate outwardly of the annular formation 29. The fastener halves are sewn to the flaps so that their edges 25 and 36 adjoin along the edge 19 between the flaps.

Figure 8:
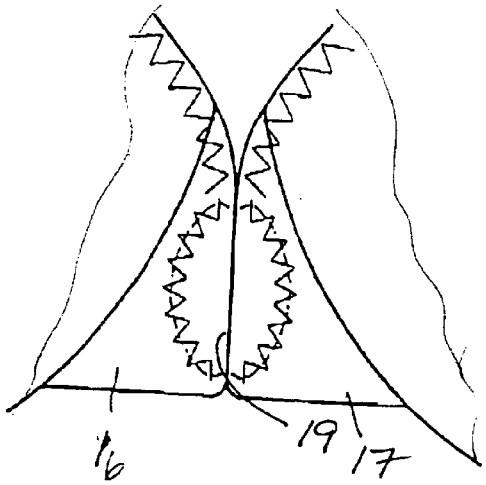
FIG. 8 is a diagrammatic front view of the brassiere.

As a result, the fastener, while visible in FIG. 7, is invisible in FIGS. 8 and 9. To open the brassiere from the front, the two fastener halves 21 and 22 are rotated at the edge 19 so that the lug 40 is drawn out of the recess 30 and the projection 41 out of the opening 31. Closure is effected by inserting the projection 41 in the opening 31 and rotating the fastener halves until their plates are coplanar.

Figure 10:
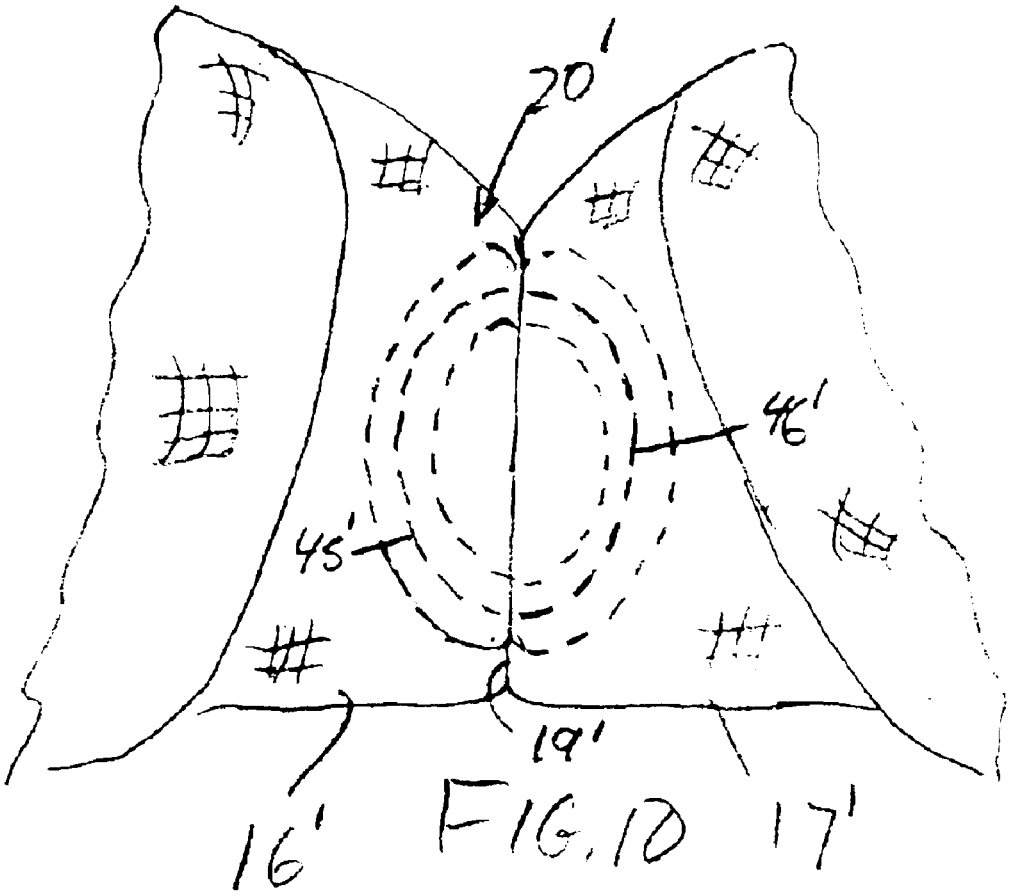
FIG. 10 is a view similar to FIG. 8 but illustrating another embodiment of the invention.

In FIG. 10, we show the front of a brassiere with the fastener in place and illustrated by broken lines since it is fully concealed between the fabric of the two halves of the brassiere front, namely, the flaps 16' and 17'.

The fastener 20' has its halves attached to the flaps by single-needle stitching at 45', 46' through each of the sewing flanges. A single-needle stitch has advantages in some cases as being less irritating to the skin.

We claim:

1. A front closure for a brassiere comprising:

a female closure half having a first semielliptical plate with a planar obverse surface delimited by a straight edge and a curved edge, an annular formation on a reverse side of said semielliptical plate overhanging said straight edge, and an elongated opening formed in said annular formation along said straight edge whereby a ledge is formed by said plate in said annular formation; and a male closure half having a second semielliptical plate with a planar obverse surface delimited by a straight edge and a curved edge, and a lug on a reverse side of said second semielliptical plate projecting over said straight edge engageable in said opening with said closure halves positioned transverse to one another, and engaging with a snap fit in said annular formation while underlying said ledge upon rotation of said closure halves into a planar position in which said planar surfaces are coplanar, said straight edges lying in contact with one another in said planar position, said semielliptical plates being attachable to juxtaposed edges of a brassiere.

2. The front closure defined in claim 1 wherein said first plate outwardly of said annular formation and said second plate outwardly of said lug are thin sewing flanges pierceable by a sewing needle stitching said closure halves to the respective edges of said brassiere.

3. The front closure defined in claim 2 wherein said annular formation is generally elliptical and surrounds a generally rectangular recess with rounded corners.

4. The front closure defined in claim 3 wherein each of said plates has curved ends connecting the respective straight edge with the respective curved edge.

5. The front closure defined in claim 4 which is composed of polyamide.

6. The front closure defined in claim 5 wherein said front closure is composed of nylon 6.

7. A brassiere having a pair of cups with respective flaps adapted to abut at edges of said flaps and a front closure having a female closure half stitched to a back of one of said flaps and a male closure half stitched to the other of said flaps, said female closure half having a first semielliptical plate with a planar obverse surface delimited by a straight edge and a curved edge, an annular formation on a reverse aide of said semielliptical plate overhanging said straight edge, and an elongated opening formed in said annular formation along said straight edge whereby a ledge is formed by said plate in said annular formation; and said male closure half having a second semielliptical plate with a planar obverse surface delimited by a straight edge and a curved edge, and a lug on a reverse side of said second semielliptical plate projecting over said straight edge engageable in said opening with said closure halves positioned transverse to one another, and engaging with a snap fit in said annular formation while underlying said ledge upon rotation of said closure halves into a planar position in which said planar surfaces are coplanar, said straight edges lying in contact with one another in said planar position whereby said flaps are connected in said planar position of said male and female closure halves so that the edges of said flaps adjoin and said front closure is invisible from the front of the brassiere.

8. The brassiere defined in claim 7 wherein said plates form sewing flanges outwardly of said annular formation and said lug and are pierceable by a sewing needle stitching said closure halves to the respective flaps of the brassiere.

9. The brassiere defined in claim 8 wherein said sewing flanges are attached to said flaps by zigzag stitching.

10. The brassiere defined in claim 9 wherein said annular formation is generally elliptical and surrounds a generally rectangular recess with rounded corners.

11. The brassiere defined in claim 8 wherein said sewing flanges are attached to the flaps by single-needle stitching.

* * * * *